US009851652B2

(12) United States Patent
Gilliam et al.

(10) Patent No.: US 9,851,652 B2
(45) Date of Patent: Dec. 26, 2017

(54) INSERT MOLDED BEARING FOR A ROTATABLE COMPONENT OF AN IMAGE FORMING DEVICE

(71) Applicant: LEXMARK INTERNATIONAL, INC., Lexington, KY (US)

(72) Inventors: Trey Dustin Gilliam, Lexington, KY (US); Philip John Male, Lexington, KY (US); Ganesh Vivayak Phatak, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 15/346,159

(22) Filed: Nov. 8, 2016

(65) Prior Publication Data

US 2017/0176882 A1 Jun. 22, 2017

Related U.S. Application Data

(60) Provisional application No. 62/270,080, filed on Dec. 21, 2015.

(51) Int. Cl.
*G03G 15/02* (2006.01)

(52) U.S. Cl.
CPC ..... *G03G 15/0233* (2013.01)

(58) Field of Classification Search
CPC ..... G03G 15/0233; G03G 15/757
See application file for complete search history.

(56) References Cited

U.S. PATENT DOCUMENTS 5,768,660 A * 6/1998 Kurihara ..... G03G 15/0216 361/221
2013/0022368 A1* 1/2013 Takarada ..... G03G 21/1867 399/110

OTHER PUBLICATIONS

Photographs (x3) of a prior art "Lexmark C522, C524, C530, C532, C534 Black Return Program Toner Cartridge" having a conductive metal insert molded developer roll bearing.

* cited by examiner

*Primary Examiner* — Hoang Ngo
(74) *Attorney, Agent, or Firm* — Justin M. Tromp

(57) ABSTRACT

A bearing assembly for supporting a rotatable component of an electrophotographic image forming device according to one example embodiment includes a metal bearing insert molded into an electrically nonconductive plastic shell. The metal bearing includes a bearing surface that defines a cylindrical opening for receiving an axial end of a shaft. The plastic shell covers an entire outer circumferential surface of the metal bearing and an inner axial side of a portion of the metal bearing forming the opening is inset from an inner axial side of the plastic shell such that the plastic shell shields the metal bearing from electrical arcing.

8 Claims, 8 Drawing Sheets

INSERT MOLDED BEARING FOR A ROTATABLE COMPONENT OF AN IMAGE FORMING DEVICE

CROSS REFERENCES TO RELATED APPLICATIONS

This application claims priority to U.S. Provisional Patent Application Ser. No. 62/270,080, filed Dec. 21, 2015, entitled "Insert Molded Bearing fix a Rotatable Component of an Image Forming Device," the content of which is hereby incorporated by reference in its entirety.

BACKGROUND

1. Field of the Disclosure

The present disclosure relates generally to image forming devices and more particularly to an insert molded bearing for a rotatable component of an image forming device.

2. Description of the Related Art

Various rotatable components of an electrophotographic image forming device require an applied voltage to function properly. One example of such a component that requires an applied voltage is a charge roll that charges the surface of a photoconductive drum. Intermittent or total loss of electrical contact to the charge roll can result in severe print detects visible to the user. The electrical path to the charge roll is typically provided through bearings that support the axial ends of a shaft of the charge roll. One approach is to use an electrically conductive plastic bearing connected to a metal compression spring that contacts an electrically conductive contact pad. However, conductive plastics are highly sensitive to the molding process used to form the bearing. If the conductive agent is not evenly and properly dispersed throughout the part, conductive plastics can have variable and overall high resistance values that can lead to print defects. Creepage and clearance concerns must also be addressed when using conductive plastic due to the relatively high voltage nature of charging. A typical area of concern is the proximity of the conductive plastic charge roll bearing to other components, such as the photoconductive drum. Insufficient distance can result in arcing between the charge roll bearing and the photoconductive drum, causing a print defect referred to as black line shorts.

Another approach is to provide electrical contact to the charge roll through a metal bearing that supports the axial end of the shaft of the charge roll and that is snap-fitted or slid into a. nonconductive plastic shell that encapsulates the metal bearing in order to shield the metal bearing from the photoconductive drum. This approach reduces the risk of arcing between the charge roll bearing and the photoconductive drum but also increases the cost and complexity of the bearing assembly in comparison with an electrically conductive plastic bearing.

Instead of providing electrical contact to the charge roll through the charge roll bearing, another approach is to provide electrical contact to the shaft of the charge roll independent of the charge roll bearing, such as through a cantilevered sheet metal spring that touches the end of the shaft of the charge roll. This approach reduces the risk of arcing between the charge roll and the photoconductive drum. However, connections to the end of the shaft of the charge roll typically require additional space compared to the use of a conductive charge roll bearing, which conflicts with consumer preferences for smaller image forming devices.

Accordingly, an improved bearing capable of providing electrical contact to a rotatable component, such as a charge roll, is desired.

SUMMARY

An assembly for an electrophotographic image forming device according to one example embodiment includes a photoconductive drum having an outer surface and a charge roll. having an outer surface in contact with the outer surface of the photoconductive drum. The charge roll has a shaft that includes a pair of axial ends. A charge roll bearing includes an electrically conductive metal bearing insert molded into an electrically nonconductive plastic shell. The metal bearing includes a bearing surface that rotatably supports one of the pair of axial ends of the shaft. The plastic shell encapsulates all portions of the metal bearing that are positioned adjacent to the photoconductive drum such that the plastic shell shields the metal bearing from electrical arcing with the photoconductive drum.

An assembly for an electrophotographic image forming device according to another example embodiment includes a photoconductive drum having an outer surface and a charge roll having an outer surface in contact with the outer surface of the photoconductive drum. The charge roll has a shaft that includes a pair of axial ends. A charge roll bearing includes an electrically conductive metal bearing insert molded into an electrically nonconductive plastic shell. The metal bearing includes a bearing surface that rotatably supports one of the pair of axial ends of the shaft. The plastic shell covers an entire outer circumferential surface of the metal bearing that is proximate to the photoconductive drum and an inner axial side of the metal bearing is inset from an inner axial side of the plastic shell such that the plastic shell shields the metal bearing from electrical arcing with the photoconductive drum.

A bearing assembly for supporting a rotatable component of an electrophotographic image forming device according to one example embodiment includes a metal bearing insert molded into an electrically nonconductive plastic shell. The metal bearing includes a bearing surface that defines a cylindrical opening for receiving an axial end of a shaft. to The plastic shell covers an entire outer circumferential surface of the metal bearing and an inner axial side of a portion of the metal bearing forming the opening is inset from an inner axial side of the plastic shell such that the plastic shell shields the metal bearing from electrical arcing.

BRIEF DESCRIPTION OF THE DRAWINGS

The accompanying drawings incorporated in and forming a part of the specification, illustrate several aspects of the present disclosure, and together with the description serve to explain the principles of the present disclosure.

DETAILED DESCRIPTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical, and mechanical changes, etc., may be made without departing from the scope of the present disclosure. Examples merely typify possible variations. Portions and features of some embodiments may be included in ear substituted for those of others. The following description, therefore, is not to be taken in a limiting sense and the scope of the present disclosure is defined only by the appended claims and their equivalents.

Figure 1:
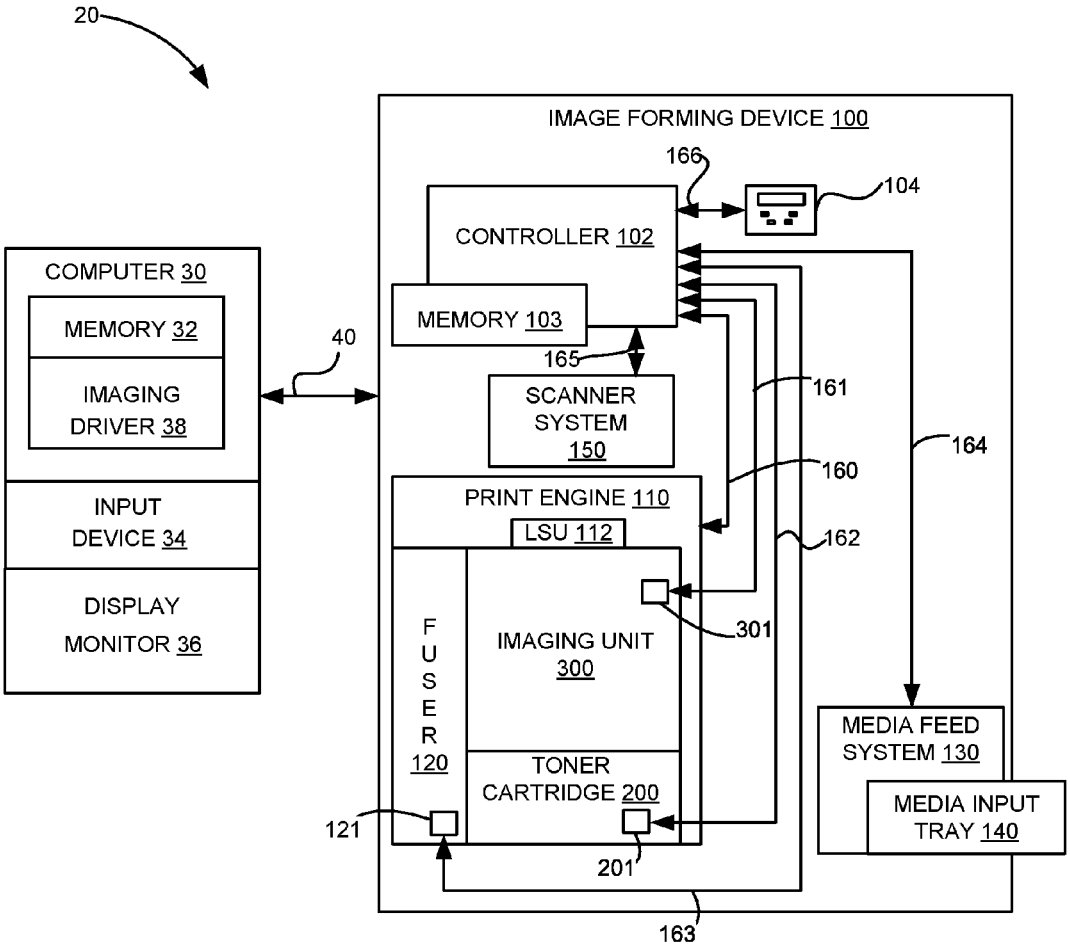
FIG. 1 is a block diagram depiction of an imaging system according to one example embodiment.

Referring now to the drawings and more particularly to FIG. 1, there is shown a block diagram depiction of an imaging system 20 according to one example embodiment. Imaging system 20 includes an image forming device 100 and a computer 30. Image forming device 100 communicates with computer 30 via a communications link 40. As used herein, the term "communications link" generally refers to any structure that facilitates electronic communication between multiple components and may operate using wired or wireless technology and may include communications over the Internet.

In the example embodiment shown in FIG. 1, image forming device 100 is a multifunction machine (sometimes referred to as an all-in-one (AIO) device) that includes a. controller 102, a print engine 110, a laser scan unit (LSU) 112, one or more toner bottles or cartridges 200, one or more imaging units 300, a fuser 120, a user interface 104, a media feed system 130 and media input tray 140 and a scanner system 150. Image forming device 100 may communicate with computer 30 via a standard communication protocol, such as, for example, universal serial bus (USB), Ethernet or IEEE 802.xx. Image forming device 100 may be, for example, an electrophotographic printer/copier including an integrated scanner system 150 or a standalone electrophotographic printer.

Controller 102 includes a processor unit and associated memory 103 and may be formed as one or more Application Specific Integrated Circuits (ASICs). Memory 103 may be any volatile or non-volatile memory or combination thereof such as, for example, random access memory (RAM), read only memory (ROM, flash memory and/or non-volatile RAM (NVRAM). Alternatively, memory 103 may be in the form of a separate electronic memory (e.g., RAM, ROM, and/or NVRAM), a hard drive, a CD or DVD drive, or any memory device convenient for use with controller 102. Controller 102 may be, for example, a combined printer and scanner controller.

In the example embodiment illustrated, controller 102. communicates with print engine 110 via a communications link 160. Controller 102 communicates with imaging unit(s) 300 and processing circuitry 301 on each imaging unit 300 via communications link(s) 161. Controller 102 communicates with toner cartridge(s) 200 and processing circuitry 201 on each toner cartridge 200 via communications link(s) 162. Controller 102 communicates with fuser 120 and processing circuitry 121 thereon via a communications link 163. Controller 102 communicates with media feed system 130 via a communications link 164. Controller 102 communicates with scanner system 150 via a communications link 165. User interface 104 is communicatively coupled to controller 102 via a communications link 166. Processing circuitry 121, 201, 301 may include a processor and associated memory such as RAM, ROM, and/or NVRAM and may provide authentication functions, safety and operational interlocks, operating parameters and usage information related to fuser 120, toner cartridge(s) 200 and imaging unit(s) 300, respectively. Controller 102 processes print and scan data and operates print engine 110 during printing and scanner system 150 during scanning.

Computer 30, which is optional, may be, for example, a personal computer, including memory 32, such as RAM, ROM, and/or NVRAM, an input device 34, such as a keyboard and/or a mouse, and a display monitor 36. Computer 30 also includes a processor, input/output (I/O) interfaces, and may include at least one mass data storage device, such as a hard drive, a CD-ROM and/or a DVD unit (not shown). Computer 30 may also be a device capable of communicating with image forming device 100 other than a personal computer such as, for example, a tablet computer, a smartphone, or other electronic device.

In the example embodiment illustrated, computer 30 includes in its memory a software program including program instructions that function as an imaging driver 38, e.g., printer/scanner driver software, for image forming device 100. Imaging driver 38 is in communication with controller 102 of image forming device 100 via communications link 40. Imaging driver 38 facilitates communication between image forming device 100 and computer 30. One aspect of imaging driver 38 may be, for example, to provide formatted print data to image forming device 100, and more particularly to print engine 110, to print an image. Another aspect of imaging driver 38 may be, for example, to facilitate the collection of scanned data from scanner system 150.

In some circumstances, it may be desirable to operate image forming device 100 in a standalone mode. In the standalone mode, image forming device 100 is capable of functioning without computer 30. Accordingly, all or a portion of imaging driver 38, or a similar driver, may be located in controller 102 of image forming device 100 so as to accommodate printing and/or scanning functionality when operating in the standalone mode.

Figure 2:
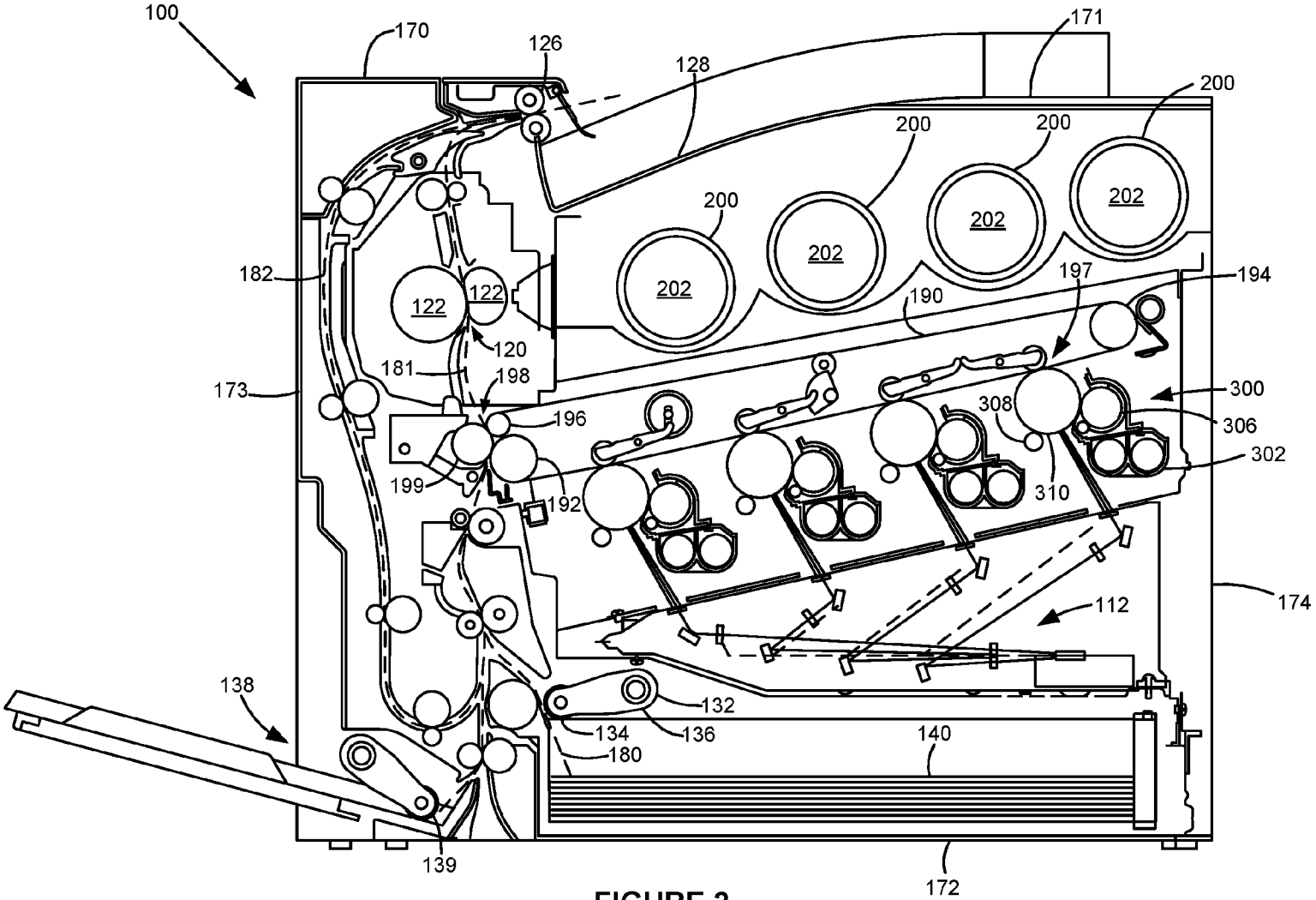
FIG. 2 is a schematic diagram of an image forming device according to one example embodiment.

FIG. 2 illustrates a schematic view of the interior of an example image forming device 100. For purposes of clarity, the components of only one of the imaging units 300 are labeled in FIG. 2. Image forming device 100 includes a housing 170 having a top 171, bottom 172, front 173, rear 174 and a pair of sides (one facing out of the page and one facing into the page as viewed in FIG. 2). Housing 170 includes one or more media input trays 140 positioned therein. Trays 140 are sized to contain a stack of media sheets. As used herein, the term media is meant to encompass not only paper but also labels, envelopes, fabrics, photographic paper or any other desired substrate. Trays 140 are preferably removable for refilling. A media path 180 extends through image forming device 100 for moving the media sheets through the image transfer process. Media path 180 includes a simplex path 181 and may include a duplex path 182. A media sheet is introduced into simplex path 181 from tray 140 by a pick mechanism 132. In the example embodiment shown, pick mechanism 132 includes a roll 134 positioned at the end of a pivotable arm 136. Roll 134 rotates to move the media sheet from tray 140 and into media path 180. The media sheet is then moved along media path 180 by various transport rollers. Media sheets may also be introduced into media path 180 by a manual feed 138 having one or more rolls 139.

In the example embodiment shown, image forming device 100 includes four toner cartridges 200 removably mounted in housing 170 in a mating relationship with four corresponding imaging units 300, which are also removably mounted in housing 170, Each toner cartridge 200 includes a reservoir 202 for holding toner and an outlet port in communication with an inlet port of its corresponding imaging unit 300 for transferring toner from reservoir 202 to imaging unit 300. Toner is transferred periodically from a respective toner cartridge 200 to its corresponding imaging unit 300 in order to replenish the imaging unit 300. In the example embodiment illustrated, each toner cartridge 200 is substantially the same except for the color of toner contained therein. In one embodiment, the four toner cartridges 200 contain yellow, cyan, magenta and black toner, respectively.

In the example embodiment illustrated, image forming device 100 utilizes what is commonly referred to as a dual component development system. Each imaging unit 300 includes a reservoir 302 that stores a mixture of toner and magnetic carrier beads. The carrier beads may be coated with a polymeric film to provide triboelectric properties to attract toner to the carrier beads as the toner and the carrier beads are mixed in reservoir 302. Reservoir 302 and a magnetic roll 306 collectively form a developer unit. Magnetic roll 306 includes a stationary core that includes one or more permanent magnets and a rotatable sleeve that encircles the core. Reservoir 302 may include toner agitators, such as paddles, augers, etc., that stir the developer mix and present the developer mix to magnetic roll 306, Each imaging unit 300 also includes a charge roll 308, a photoconductive drum (PC drum) 310 and a cleaner blade (not shown) that collectively form a photoconductor unit. PC drums 310 are mounted substantially parallel to each other when the imaging units 300 are installed in image forming device 100. In the example embodiment illustrated, each imaging unit 300 is substantially the same except for the color of toner contained therein.

Each charge roll 308 forms a nip with the corresponding PC drum 310. During a print operation, charge roll 308 charges the surface of PC drum 310 to a specified voltage, such as, for example, −1000 volts. A laser beam from LSU 112 is then directed to the surface of PC drum 310 and selectively discharges those areas it contacts to form a latent image. In one embodiment, areas on PC drum 310 illuminated by the laser beam are discharged to approximately −300 volts. The permanent magnet(s) of magnetic roll 306 attract the carrier beads in reservoir 302 having toner thereon to the outer surface of the sleeve of magnetic roll 306. The sleeve of magnetic roll 306 transports the carrier beads having toner thereon past a trim bar that trims the mix of carrier beads and toner to a predetermined average height on the outer surface of the sleeve. The sleeve of magnetic roll 306 then transports the carrier heads having toner thereon to the corresponding PC drum 310. Electrostatic forces from the latent image on PC drum 310 strip the toner from the carrier beads to form a toner image on the surface of PC drum 310.

An intermediate transfer mechanism (ITM) 190 is disposed adjacent to the PC drums 310. In this embodiment, ITM 190 is formed as an endless belt trained about a drive roll 192, a tension roll 194 and a back-up roll 196. During image forming operations, ITM 190 moves past PC drums 310 in a clockwise direction as viewed in FIG. 2. one or more of PC drums 310 apply toner images in their respective colors to ITM 190 at a respective first transfer nip 197. In one embodiment, a positive voltage field attracts the toner images from PC drums 310 to the surface of the moving ITM 190. ITM 190 rotates and collects the one or more toner images from PC drums 310 and then conveys the toner images to a media sheet at a second transfer nip 198 formed between a transfer roll 199 and ITM 190, which is supported by back-up roll 196. The cleaner blade/roll removes any toner remnants on PC drum 310 so that the surface of PC drum 310 may be charged and developed with toner again.

A media sheet advancing through simplex path 181 receives the toner image from ITM 190 as it moves through the second transfer nip 198. The media sheet with the toner image is then moved along the media path 180 and into fuser 120. Fuser 120 includes fusing rolls or belts 122 that form a nip to adhere the toner image to the media sheet. The fused media sheet then passes through exit rolls 126 located downstream from fuser 120. Exit rolls 126 may be rotated in either forward or reverse directions. In a forward direction, exit rolls 126 move the media sheet from simplex path 181 to an output area 128 on top 171 of image forming device 100. In a reverse direction, exit rolls 126 move the media sheet into duplex path 182 for image formation on a second side of the media sheet.

While the example image forming device 100 shown in FIG. 2 illustrates four toner cartridges 200 and four corresponding imaging units 300, it will be appreciated that a monocolor image forming device 100 may include a single toner cartridge 200 and corresponding imaging unit 300 as compared to a multicolor image forming device 100 that may include multiple toner cartridges 200 and imaging units 300. Further, although image forming device 100 utilizes ITM 190 to transfer toner to the media, toner may be applied directly to the media by the one or more photoconductive drums 310 as is known in the art.

While the example image forming device 100 shown in FIG. 2 utilizes a dual component development system, in another embodiment, image forming device 100 utilizes what is commonly referred to as a single component development system. In this embodiment, a toner adder roll in each developer unit has an outer surface that is in contact with and forms a nip with the outer surface of a corresponding developer roll. As the toner adder roll and the developer roll rotate, the toner adder roll supplies toner in reservoir 302 to the developer roll. The developer roll is electrically charged and electrostatically attracts the toner particles supplied by the toner adder roll. A doctor blade positioned along each developer roll provides a substantially uniform layer of toner on the developer roll. The outer surface of the developer roll is also in contact with and forms a nip with the outer surface of a corresponding PC drum 310. As the developer roll and PC drum 310 rotate, toner particles are electrostatically transferred from the developer roll to the latent image on PC drum 310 forming a toned image on the surface of PC drum 310. PC drum 310 is charged by charge roll 308 and cleaned by a cleaner blade as discussed above.

Figure 3:
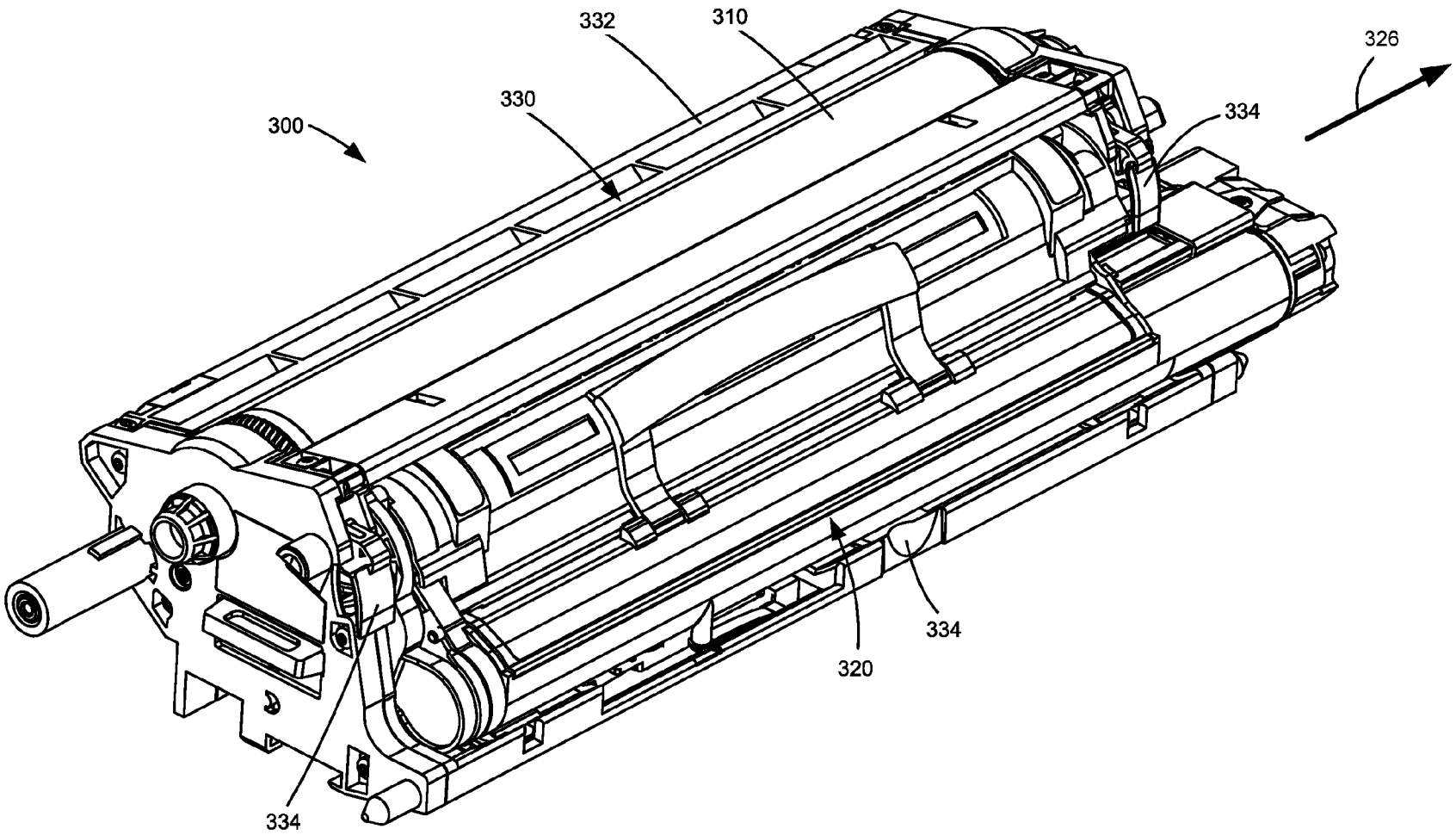
FIG. 3 is a perspective view of an imaging unit including a developer unit and a photoconductor unit according to one example embodiment.
Figure 4:
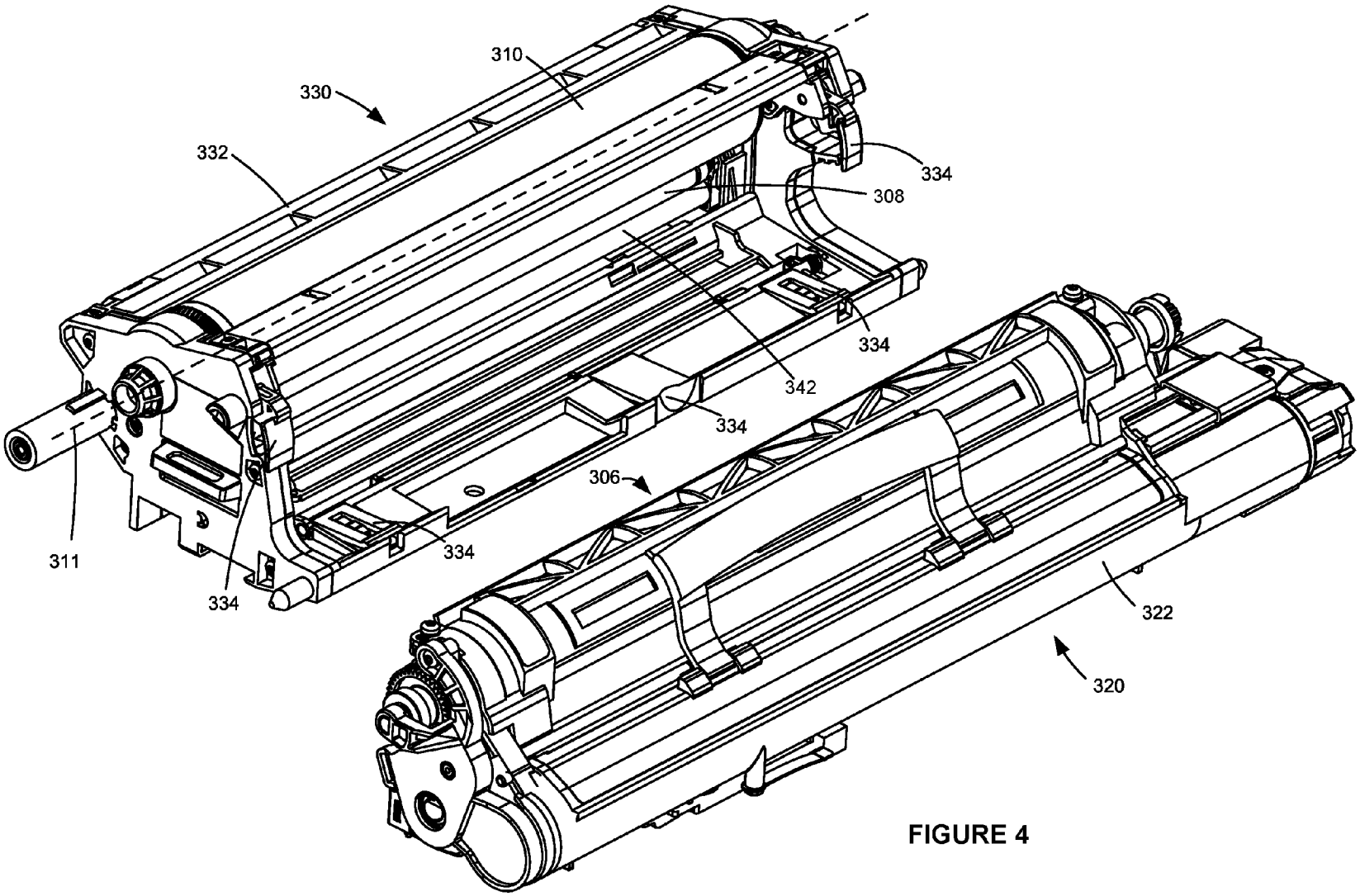
FIG. 4 is a perspective view of the imaging unit showing the developer unit separated from the photoconductor unit according to one example embodiment.

FIGS. 3 and 4 show imaging unit 300 according to one example embodiment. Imaging unit 300 includes a developer unit 320 and a photoconductor unit (PC unit) 330. In the example embodiment illustrated, developer unit 320 is removably coupled to PC unit 330 to permit repair or replacement of developer unit 320 independent of PC unit 330 and vice versa. In other embodiments, developer unit 320 and PC unit 330 are fixed together such that imaging unit 300 is replaced as a single unit. In the example embodiment illustrated, developer unit 320 and PC unit 330 are replaced independent of toner cartridge 200. In other embodiments, toner cartridge 200, developer unit 320 and PC unit 330 are replaced as a single unit. Additional configurations of toner cartridge 200, developer unit 320 and PC unit 330 may be used as desired. PC unit 330 includes a housing 332 having PC drum 310 as well as charge roll 308 and a cleaner blade mounted thereto. Housing 332 extends generally along a rotational axis 311 of PC drum 310. Housing 332 may also include one or more user-actuated latches 334 that couple developer unit 320 to PC unit 330 as shown in FIG. 3 for operation in image forming device 100 and that permit a user to separate developer unit 320 from PC unit 330 when imaging unit 300 is removed from image forming device 100 as shown in FIG. 4. Developer unit 320 includes a housing 322 having reservoir 302 therein. Housing 322 extends generally along a rotational axis of magnetic roll 306, which is substantially parallel to rotational axis 311 of PC drum 310. A portion of magnetic roll 306 is exposed from reservoir 302 at one side of housing 322 for mating with PC drum 310 when developer unit 320 is coupled to PC unit 330. When developer unit 320 is coupled to PC unit 330, imaging unit 300 is insertable into image forming device 100 via a sliding motion along an insertion direction 326 as indicated in FIG. 3.

Figure 5:
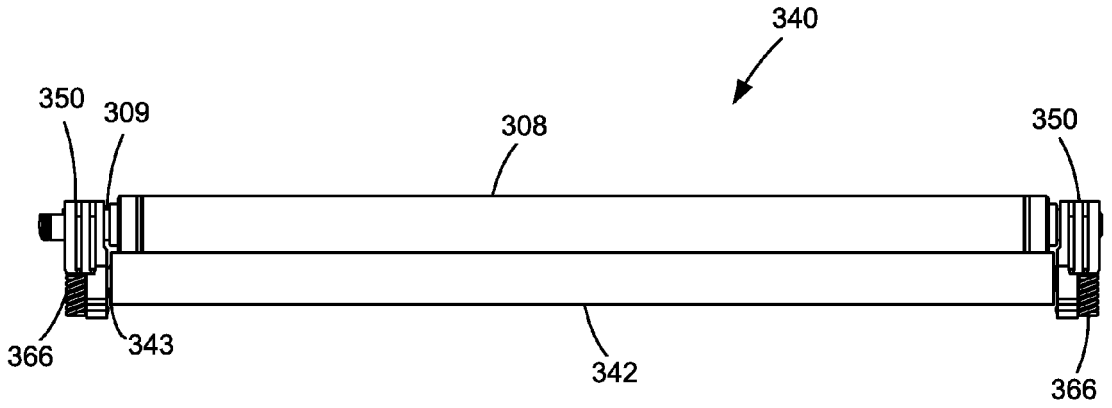
FIG. 5 is a front elevation view of a charge roll assembly of the photoconductor unit according to one example embodiment.
Figure 6:
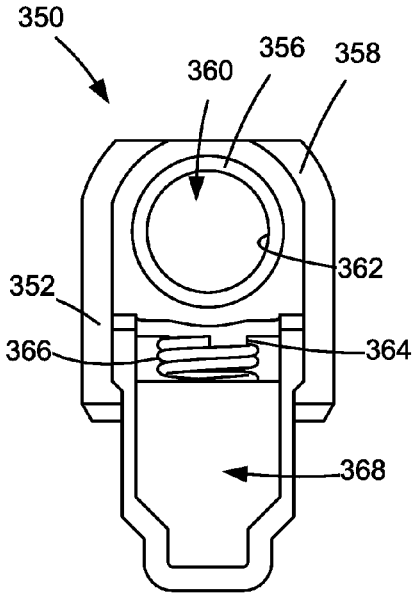
FIG. 6 is an inner axial elevation view of a charge roll bearing of the charge roll assembly according to one example embodiment.
Figure 7:
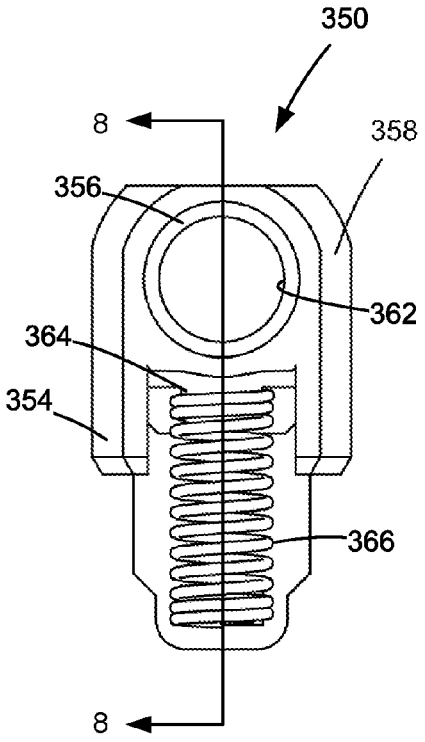
FIG. 7 is an outer axial elevation view of the charge roll bearing shown in FIG. 6.

FIG. 5 shows a charge roll assembly 340 of PC unit 330 according to one example embodiment. Charge roll assembly 340 includes charge roll 308 and may include a charge roll cleaner roll 342. An outer surface of charge roll cleaner roll 342 is in contact with the outer surface of charge roll 308 in order to remove toner particles and other contaminants from the outer surface of charge roll 308. Charge roll 308 includes a rotatable shaft 309 and charge roll cleaner roll 342 includes a rotatable shaft 343 that is parallel to shaft 309. A composite charge roll bearing 350 is positioned at each axial end of charge roll 308. Each charge roll bearing 350 receives and rotatably supports a respective axial end of shaft 309.

FIGS. 6-9 show charge roll bearing 350 according to one example embodiment. Charge roll bearing 350 includes an inner axial side 352 that faces inward axially relative to charge roll 308 and an outer axial side 354 that faces outward axially relative to charge roll 308. Charge roll bearing 350 includes an electrically conductive metal beating 356, which may be composed of, e.g., sintered bronze, that is insert molded into an electrically nonconductive plastic shell 358. Together, metal bearing 356 and plastic shell 358 form charge roll bearing 350. Metal bearing 356 includes a cylindrical opening 360 that receives shaft 309. Opening 360 is formed by a bearing surface 362 that guides and supports the rotation of a respective axial end of shaft 309. Plastic shell 358 includes a cylindrical opening 361 that is aligned with opening 360 in order to permit shaft 309 to enter opening 360 and contact bearing surface 362. In the embodiment illustrated, metal bearing 356 includes a tab 364 extending therefrom that receives an electrically conductive compression spring 366, Spring 366 provides an electrical path to metal bearing 356 and biases charge roll bearing 350 toward PC drum 310 when charge roll assembly 340 is installed in PC unit 330.

Figure 8:
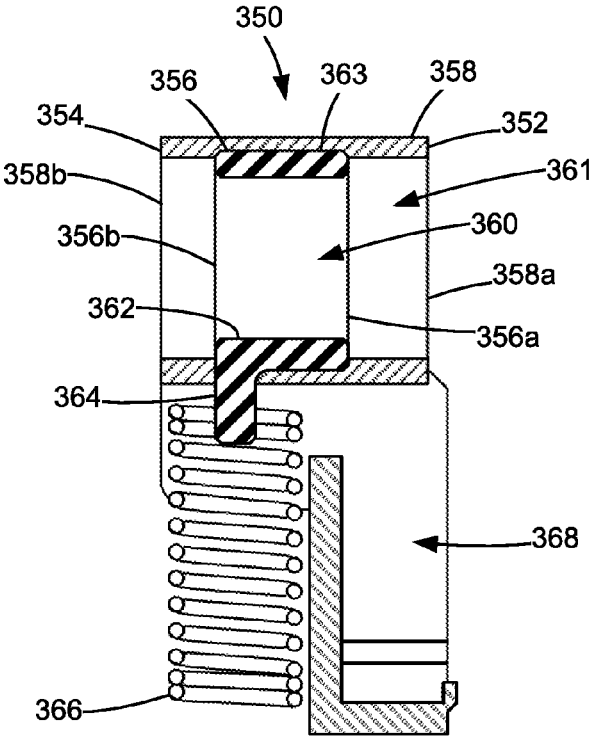
FIG. 8 is a cross-sectional view of the charge roll bearing shown in FIGS. 6 and 7 taken along line 8-8 in FIG. 7.
Figure 9:
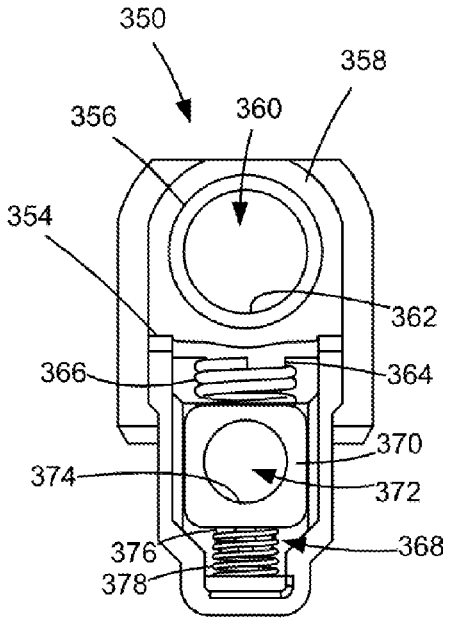
FIG. 9 is an inner axial elevation view of the charge roll bearing shown in FIGS. 6-8 with a charge roll cleaner roll bearing mounted thereon according to one example embodiment.

In the embodiment illustrated, shell 358 includes a pocket 368 formed on inner axial side 352 of charge roll bearing 350. With reference to FIGS. 8 and 9, in the embodiment illustrated, a charge roll cleaner roll bearing 370 is slidably positioned (vertically as viewed in FIG. 9) in pocket 368. Charge roll cleaner roll bearing 370 includes an opening 372 that receives shaft 343 of charge roll cleaner roll 342, Opening 372 is formed by a bearing surface 374 that guides and supports the rotation of shaft 343. In one embodiment, bearing 370 is composed of electrically nonconductive plastic. In the embodiment illustrated, bearing 370 includes a tab 376 extending therefrom that receives a compression spring 378. Spring 378 is positioned in pocket 368 and biases bearing 370 toward charge roll 308.

Figure 10:
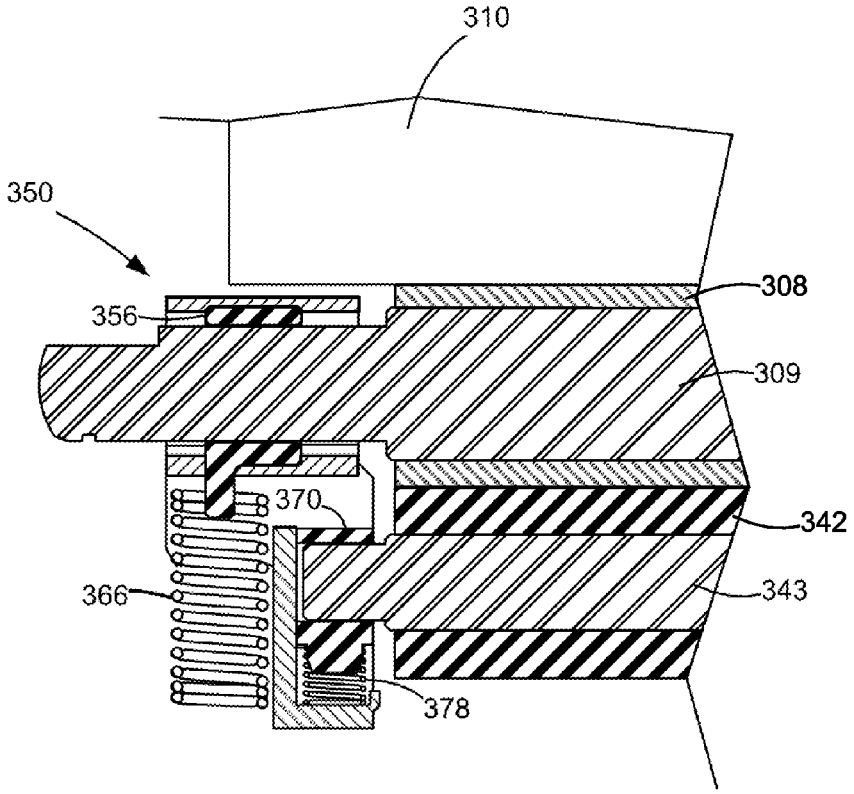
FIG. 10 is a cross-sectional view of the charge roll assembly showing the proximity of the charge roll bearing to a photoconductive drum according to one example embodiment.

FIG. 10 shows the positioning of charge roll 308 and charge roll bearing 350 relative to PC drum 310, which is illustrated schematically. The nonconductive nature of plastic shell 358 insulates metal bearing 356 from PC drum 310 and thereby reduces the risk of arcing between metal bearing 356 and PC drum 310. Plastic shell 358 encapsulates all portions of metal bearing 356 that are positioned adjacent to PC drum 310, thereby shielding metal bearing 356 from PC drum 310. For example, plastic shell 358 covers the entire outer circumferential surface 363 of metal bearing 356 that is proximate to PC drum 310. Further, as shown in FIG. 8, an inner axial side **356*a* of metal bearing 356 is inset from an inner axial side 358*a* of plastic shell 358 and an outer axial side 356*b* of metal bearing 356 is inset from an outer axial side 358*b* of plastic shell 358. In this manner, the inner and outer axial edges of opening 360 in metal bearing 356 are inset from inner and outer axial edges of opening 361 in plastic shell 358**.

Without the shielding provided by plastic shell 358 between metal bearing 356 and PC drum 310, the high voltage required for charging could create an arcing risk across the relatively small distance between metal bearing 356 and PC drum 310.

Figure 11:
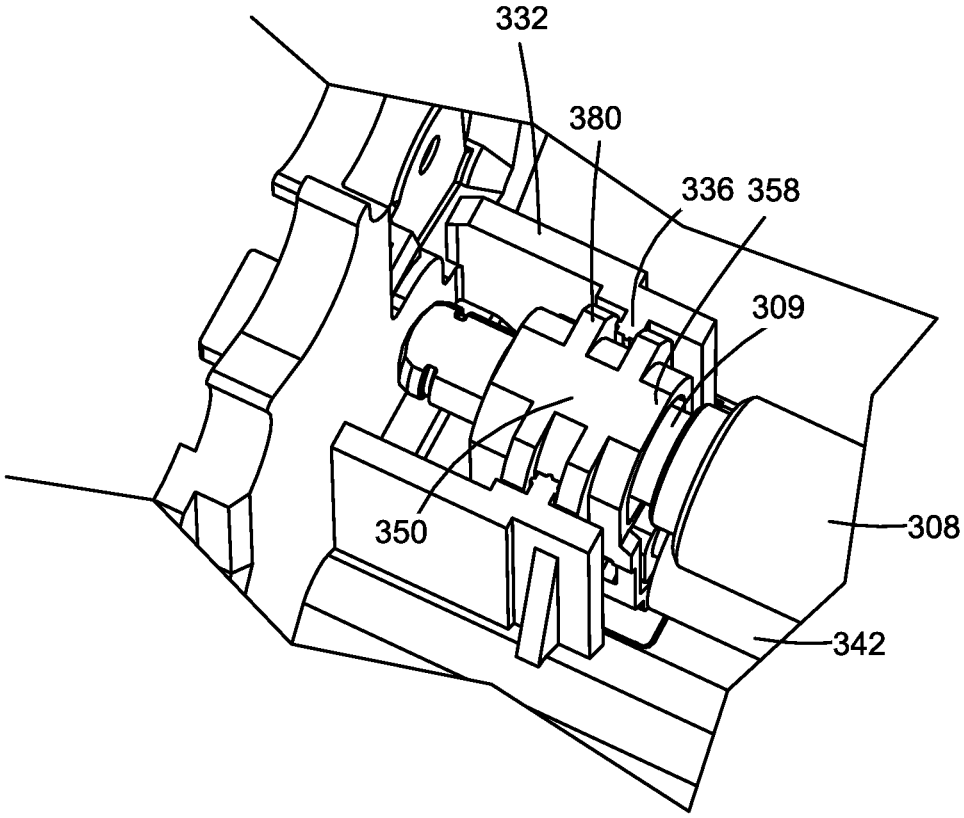
FIG. 11 is a top perspective view the charge roll assembly mounted on the photoconductor unit housing according to one example embodiment.

The plastic construction of shell 358 also provides a greater range of geometries available for charge roll bearing 350 in comparison with a metal bearing, due to greater flexibility in the molding of plastic as opposed to metal. For example, the plastic construction of shell 358 permits the inclusion of pocket 368, allowing charge roll bearing 350 to support charge roll cleaner roll bearing 370. With reference to FIG. 11, in one embodiment, plastic shell 358 also includes locating ribs 380 on its outer surface that engage corresponding rails 336 on housing 332 when charge roll assembly 340 is installed on PC unit 330. The engagement between ribs 380 and rails 336 controls the translational and rotational degrees of freedom of charge roll bearing 350.

Further, insert molding metal bearing 356 into plastic shell 358 simplifies the assembly of charge roll bearing 350 in comparison with a charge roll bearing that includes a metal hearing that is snap-fitted or slid into a plastic shell. Insert molding metal bearing 356 into plastic shell 358 also ensures that metal hearing 356 will not separate from plastic shell 358.

In some embodiments, when metal bearing 356 is molded into plastic shell 358, the high temperatures associated with the molding process cause oil migration out of metal bearing 356. If the oil migration is left unaddressed, plastic shell 358 may have a substantial amount of oil coating its outer surfaces, which risks contaminating and damaging other imaging components (e.g., crazing of PC drum 310). In order to address the risk of oil migration, in some embodiments, metal bearing 356 is soaked in a degreaser prior to molding plastic shell 358, This minimizes the net amount of oil that ends up on the outer surfaces of plastic shell 358. The application of degreaser must be balanced with the desire to maintain a minimum acceptable level of oil in the final metal bearing 356 to provide a functional bearing surface 362.

Accordingly, the present disclosure describes a bearing that includes an electrically conductive metal bearing that is insert molded into a nonconductive plastic shell. The metal bearing provides a robust conductive path to the charge roll shaft and the plastic serves as an insulative barrier between the charge roll shaft and the photoconductive drum, while still allowing complex geometry to be integrated into the part. While the example discussed above includes a bearing for a charge roll, it will be appreciated that a composite bearing that includes a metal bearing insert molded into a nonconductive plastic shell may be used to support and provide an electrical path to other rotatable components with the image forming device as desired.

The foregoing description illustrates various aspects of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

The invention claimed is:

1. An assembly for an electrophotographic image forming device, comprising:

a photoconductive drum having an outer surface;

a charge roll having an outer surface in contact with the outer surface of the photoconductive drum, the charge roll has a shaft that includes a pair of axial ends; and a charge roll bearing that includes an electrically conductive metal bearing insert molded into an electrically nonconductive plastic shell, the metal bearing includes a bearing surface that rotatably supports one of the pair of axial ends of the shaft, the plastic shell encapsulates all portions of the metal bearing that are positioned adjacent to the photoconductive drum such that the plastic shell shields the metal bearing from electrical arcing with the photoconductive drum.

2. The assembly of claim 1, wherein the metal bearing includes a tab extending therefrom away from the photoconductive drum, the tab receives an electrically conductive compression spring that provides an electrical path to the metal bearing and that biases the charge roll bearing toward the photoconductive drum.

3. An assembly for an electrophotographic image forming device, comprising:

a photoconductive drum having an outer surface;

a charge roll having an outer surface in contact with the outer surface of the photoconductive drum, the charge roll has a shaft that includes a pair of axial ends; and a charge roll bearing that includes an electrically conductive metal bearing insert molded into an electrically nonconductive plastic shell, the metal bearing includes a bearing surface that rotatably supports one of the pair of axial ends of the shaft, the plastic shell covers an entire outer circumferential surface of the metal bearing that is proximate to the photoconductive drum and an inner axial side of the metal bearing is inset from an inner axial side of the plastic shell such that the plastic shell shields the metal bearing from electrical arcing with the photoconductive drum.

4. The assembly of claim 3, wherein an outer axial side of the metal bearing is inset from an outer axial side of the plastic shell.

5. The assembly of claim 3, wherein the metal bearing includes a tab extending therefrom away from the photoconductive drum, the tab receives an electrically conductive compression spring that provides an electrical path to the metal bearing and that biases the charge roll bearing toward the photoconductive drum.

6. A bearing assembly for supporting a rotatable component of an electrophotographic image forming device, comprising:

a metal bearing insert molded into an electrically nonconductive plastic shell, the metal bearing includes a bearing surface that defines a cylindrical opening for receiving an axial end of a shaft, the plastic shell covers an entire outer circumferential surface of the metal bearing and an inner axial side of a portion of the metal bearing forming the opening is inset from an inner axial side of the plastic shell such that the plastic shell shields the metal bearing from electrical arcing.

7. The bearing assembly of claim 6, wherein an outer axial side of the portion of the metal bearing forming the opening is inset from an outer axial side of the plastic shell.

8. The bearing assembly of claim 6, wherein the metal bearing includes a tab extending therefrom, the tab receives an electrically conductive compression spring that provides an electrical path to the metal bearing and that applies a physical bias to the metal bearing.

* * * * *